US007183210B2

(12) United States Patent
Shibano et al.

(10) Patent No.: US 7,183,210 B2
(45) Date of Patent: Feb. 27, 2007

(54) METHOD FOR PREPARING LARGE-SIZE SUBSTRATE

(75) Inventors: Yukio Shibano, Joetsu (JP); Daisuke Kusabiraki, Joetsu (JP); Shuhei Ueda, Joetsu (JP); Atsushi Watabe, Joetsu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 99 days.

(21) Appl. No.: 11/059,530

(22) Filed: Feb. 17, 2005

(65) Prior Publication Data

US 2005/0181611 A1 Aug. 18, 2005

(30) Foreign Application Priority Data

Feb. 18, 2004 (JP) ..... 2004-041396

(51) Int. Cl.
*H01L 21/302* (2006.01)
*H01L 21/461* (2006.01)

(52) U.S. Cl. ..... 438/689; 438/680; 365/237.2

(58) Field of Classification Search ..... 438/680, 438/689, 14, 16; 356/237.2, 600, 630, 632, 356/636

See application file for complete search history.

(56) References Cited

U.S. PATENT DOCUMENTS 5,484,325 A 1/1996 Shank
5,975,996 A * 11/1999 Settles ..... 451/102
2003/0143403 A1 7/2003 Shibano et al.

FOREIGN PATENT DOCUMENTS

EP 1 333 313 A1 8/2003
JP 2003-292346 A 10/2003

* cited by examiner

*Primary Examiner*—Phuc T. Dang
(74) *Attorney, Agent, or Firm*—Birch, Stewart, Kolasch & Birch, LLP

(57) ABSTRACT

A large-size substrate having improved flatness is prepared by measuring the flatness of one surface or opposite surfaces of a large-size substrate having a diagonal length of at least 500 mm, and partially removing raised portions on the one surface or opposite surfaces of the substrate by means of a processing tool on the basis of the measured data. The processing tool is adapted to blast a slurry of microparticulates in water carried on compressed air against the substrate.

7 Claims, 3 Drawing Sheets

METHOD FOR PREPARING LARGE-SIZE SUBSTRATE

CROSS-REFERENCE TO RELATED APPLICATION

This non-provisional application claims priority under 35 U.S.C. §119(a) on Patent Application No. 2004-041396 filed in Japan on Feb. 18, 2004, the entire contents of which are hereby incorporated by reference.

TECHNICAL FIELD

This invention relates to a method for preparing large-size substrates suitable as synthetic quartz glass substrates for photomasks and especially, substrates for use in TFT liquid crystal panels.

BACKGROUND ART

In general, TFT liquid crystal panels are constructed by filling liquid crystals between an array side substrate having TFT devices built therein and a color filter substrate. They are based on the active matrix addressing scheme where voltage is applied by TFTs for controlling the alignment of liquid crystals.

In the manufacture of the array side substrate, patterns are formed in plural layers on a mother glass such as non-alkaline glass by repeating light exposure through originals having circuit patterns drawn thereon, known as large-size photomasks. On the other hand, the color filter side substrate is manufactured by a lithographic process known as dye immersion process. In the manufacture of both array and color filter side substrates, large-size photomasks are necessary. For performing light exposure at a high accuracy, such large-size photomasks are typically made of synthetic quartz glass characterized by a low coefficient of linear thermal expansion.

So far, liquid crystal panels have progressed to higher definitions from VGA to SVGA, XGA, SXGA, UXGA and QXGA. It is believed that degrees of definition ranging from 100 pixels per inch (ppi) class to 200 ppi class are necessary. Accordingly, a strict exposure accuracy, especially overlay accuracy, is imposed on the TFT array side.

Some panels are manufactured using the technology known as low-temperature polysilicon. In this case, it has been studied to bake a driver circuit or the like on a peripheral portion of glass, aside from the panel pixels, which requires light exposure of higher definition.

For large-size photomask-forming substrates, it is known that their shape has an influence on the accuracy of light exposure. As shown in FIG. 1, for example, when light exposure is performed using two large-size photomask-forming substrates having different flatness, the patterns are shifted due to the difference between light paths. More specifically in FIGS. 1A and 1B, broken lines represent light paths when light advances straight and the mask is ideally planar. Actually, light paths are shifted outward or inward, as shown by solid lines, depending on whether the substrate upper surface is concave or convex. Also, for an exposure apparatus using a focusing optical system, there arises a phenomenon that the focus is shifted from the exposure plane, resulting in degraded resolution. Thus, for light exposure of higher accuracy, there is a need for large-size photomask-forming substrates having a higher flatness.

To implement the multiple pattern technology through a single light exposure for increasing the productivity of panels, there arises a demand for a large-size photomask-forming substrate having a diagonal length as large as 1500 mm. Both a larger size and a higher flatness are required at the same time.

Large-size photomask-forming substrates are generally manufactured by lapping plate-shaped synthetic quartz with a slurry of loose abrasives (e.g., alumina) suspended in water for thereby removing irregularities on the surface, then polishing with a slurry of abrasives (e.g., ceria) suspended in water. To this end, a double- or single-side processing machine is used.

However, these processing methods, which utilize for flatness correction the reaction force against the elastic deformation generated when the substrate itself is forced against the processing platen, have a drawback that as the substrate size becomes larger, the reaction force considerably decreases, leading to a reduction of the ability to remove moderate irregularities on the substrate surface. FIG. 2A illustrates the shape of a substrate 1 when held vertically. FIG. 2B illustrates the shape of the substrate 1 during processing, indicating that the substrate 1 conforms to the platens. FIG. 2C illustrates the reaction force against the elastic deformation of the substrate 1 at that time, indicating more processing by this force ($\Delta P$) than other positions.

It is also a common practice to improve flatness using a surface grinding machine. In general, the surface grinding machine is adapted for a workpiece to traverse a predetermined gap between a workpiece-mount table and a grinding tool, for removing those portions of the workpiece which are greater than the predetermined gap. If the workpiece on the rear surface is not provided with a sufficient flatness, no improvement in flatness is achievable. This is because the workpiece is urged against the workpiece-mount table due to the grinding force of the grinding tool, and as a result, the flatness of the front surface conforms to the flatness of the rear surface.

To solve these problems, JP-A 2003-292346 corresponding to US-2003-0143403-A1 and EP 1,333,313 A1 proposes a method of processing a large-size photomask-forming substrate by partially removing raised portions and thick portions on the substrate by means of a partial processing tool. When grinding or sand blasting is utilized as the partial processing tool, however, the partial processing may cause brittle fracture to the substrate, whereby there is a possibility of generating microcrack-like defects on the substrate surface. When it is desired to produce a defect-free large-size substrate, such crack-like defects must be removed by polishing by means of a double- or single-side polishing machine following the partial processing. The polishing machine used following the partial processing needs a more quantity of labor and time for the management and maintenance of the accuracy of the polishing machine so that the polishing may not exacerbate the flatness of the substrate and/or the accuracy of thickness variation. If the flatness of the substrate or the accuracy of thickness variation is exacerbated and shifted from the desired value by the polishing following the partial processing such as sand blasting, then it becomes necessary to carry out again partial processing such as sand blasting and subsequent polishing. It would be desirable to have a processing method capable of tailoring accuracy without brittle fracture and without a need for subsequent polishing.

Also proposed is a processing tool having an abrasive cloth attached to a platen so as to avoid any brittle fracture. Since the processing speed is gradually reduced due to the wear of the abrasive cloth during the process, the processing tool must be replaced frequently, which requires a labor and a time. There is a desire to have a processing method capable of partial processing at a constant processing speed with an economic advantage without brittle fracture and without a need for subsequent polishing.

SUMMARY OF THE INVENTION

An object of the invention is to provide a method for preparing a large-size substrate, typically a large-size photomask-forming substrate, having a high flatness, by partial processing at a constant processing speed with an economic advantage without brittle fracture and without a need for subsequent polishing.

A large-size substrate, typically a large-size photomask-forming substrate is improved in flatness by measuring the flatness of one surface or opposite surfaces, preferably opposite surfaces of a starting large-size substrate having a diagonal length of at least 500 mm and optionally the parallelism of the substrate, preferably while holding the substrate vertically, and partially removing raised portions on the one surface or opposite surfaces of the substrate (and preferably, raised portions and thick portions on the opposite surfaces of the substrate if it is also desired to improve the parallelism) by means of a processing tool on the basis of the measured data, for thereby improving the flatness and optionally, the parallelism of the substrate. The inventors have found that when the processing tool is configured to blast a slurry of microparticulates (e.g., ceria, alumina or silica, preferably with a particle size of up to 3 μm) in water carried on compressed air against the substrate, the large-size substrate can be processed to a higher flatness in an economic manner without brittle fracture on the substrate surface.

Accordingly, the present invention provides a method for preparing a large-size substrate, comprising the steps of measuring the flatness of one surface or opposite surfaces of a large-size substrate having a diagonal length of at least 500 mm, and partially removing raised portions on the one surface or opposite surfaces of the substrate by means of a processing tool on the basis of the measured data, for thereby improving the flatness of the substrate. The processing tool used herein is adapted to blast a slurry of microparticulates in water carried on compressed air against the substrate.

In a preferred embodiment, the measuring step includes measuring the flatness of opposite surfaces of a large-size substrate and measuring the parallelism thereof; and the partially removing step includes partially removing raised portions and thick portions on the opposite surfaces of the substrate by means of a processing tool on the basis of the measured data.

Typically, the microparticulates are of ceria, silica or alumina and have an average particle size of up to 3 μm. Preferably, the compressed air has a pressure of 0.05 to 0.5 MPa. The large-size substrate is typically a synthetic quartz glass substrate and more preferably an array side substrate for TFT liquid crystal.

The method of the invention can process a large-size substrate without causing brittle fracture to the substrate surface, thus eliminating the labor and time which are otherwise consumed by subsequent polishing for maintaining machine accuracy. Thus a large-size substrate having a high flatness can be acquired in an economic manner.

DESCRIPTION OF THE PREFERRED EMBODIMENTS

Figure 1A:
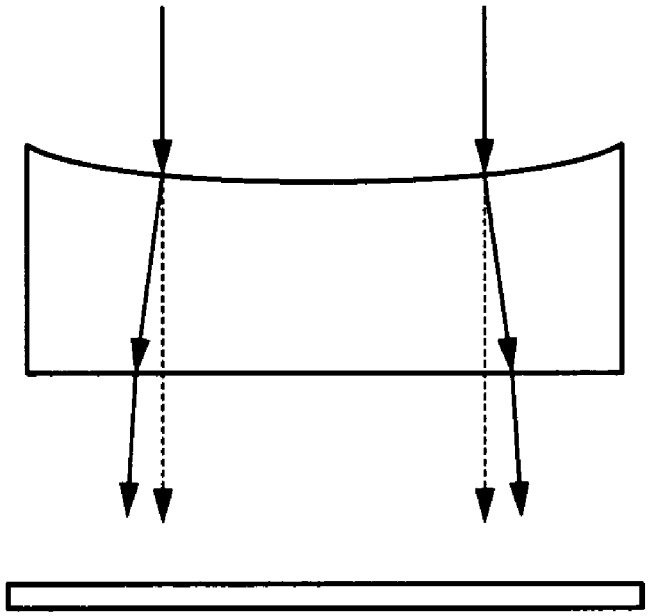
FIG. 1 illustrates light paths through a photomask substrate upon light exposure, FIG. 1A and 1B being substrates having concave and convex upper surfaces, respectively.
Figure 1B:
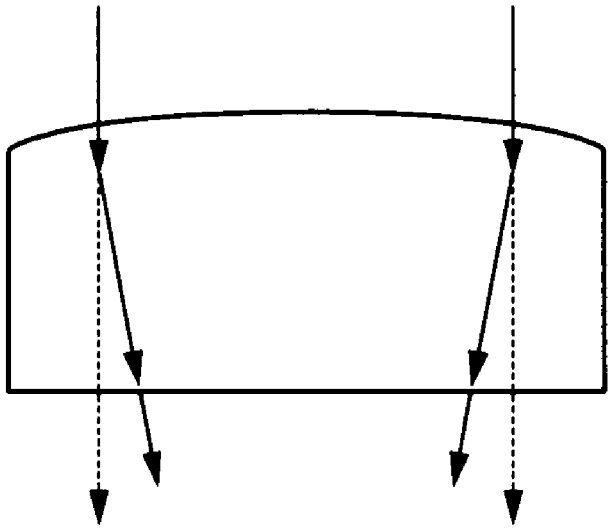
Figure 2A:
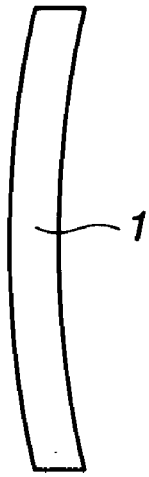
FIG. 2 illustrates polishing of a substrate by processing platens, FIG. 2A being a side view illustrating the shape of vertically held substrate, FIG. 2B being a side view illustrating the shape of substrate conforming to the platens during processing, and FIG. 2C illustrating the reaction force on the lower platen.
Figure 2B:
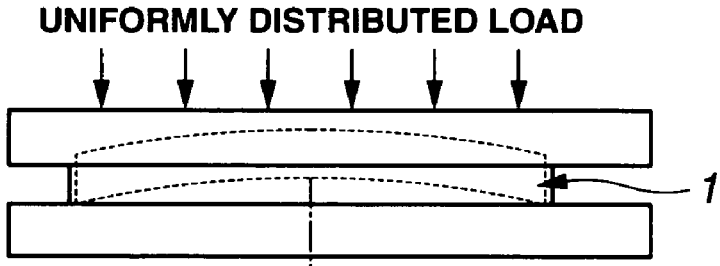
Figure 2C:
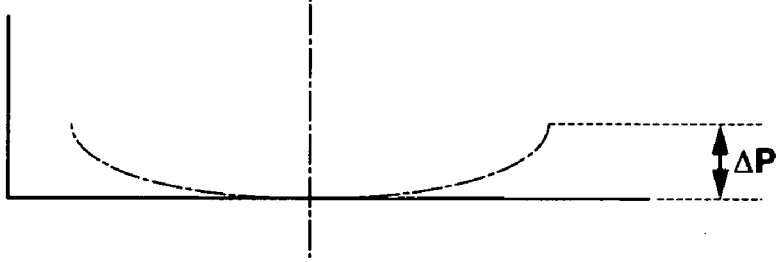

The large-size substrates, with which the present invention deals, are preferably glass substrates, more preferably synthetic quartz glass substrates which are typically used as photomask-forming substrates and array side substrates for TFT liquid crystal panels. The substrates are sized to have a diagonal length of at least 500 mm, preferably from 500 mm to 2,000 mm. The shape of large-size substrates may be square, rectangular, circular or the like. In the case of circular substrates, the diagonal length refers to the diameter. The thickness of large-size substrates is preferably from 1 mm to 20 mm, and more preferably from 5 mm to 12 mm, though not critical. It is noted that a substrate has a pair of opposite major surfaces, often referred to as front and back surfaces, to be flattened.

The method of the invention involves the first step of measuring the flatness of one surface or opposite (front and back) surfaces of a large-size substrate to be flattened. If it is desired to improve the parallelism of a substrate as well, the measuring step includes measuring the flatness on opposite surfaces of a large-size substrate and measuring the parallelism between the opposite surfaces of the substrate. For reducing the overall processing time, in a preferred embodiment, the starting plate has been mirror finished by a double- or single-side polishing machine so as to provide as high a flatness and/or parallelism as possible. The invention is applicable to those substrates having a rough surface such as lapped, but this is economically disadvantageous because of a longer processing time. For the measurement of flatness and parallelism, for example, a flatness tester FTT-1500 by Kuroda Precision Industries Ltd. may be used. It is recommended that the measurement of flatness and parallelism be carried out while holding the substrate vertically, in order to remove any deformation of substrate by its own weight.

Next, the measured data are stored in a computer as the height data at various positions within the relevant surface of the substrate (or the front and back surfaces if flatness has been measured on both the surfaces) and additionally as the thickness data if parallelism has also been measured. In order to correct the flatness on the substrate surface to be flattened, i.e., on the flatness-measured substrate surface (typically each of the front and back surfaces of the substrate where both the surfaces are to be flattened) on the basis of these data, a quantity of material removed is computed using as the reference surface the least square surface computed for the substrate surface to be flattened (each surface where both the surfaces are to be flattened), so that the resultant height may approach the lowest point within the substrate surface to be flattened. Then a residence time of the processing tool is computed therefrom.

In a preferred embodiment wherein parallelism is also enhanced, the parallelism that the substrate will acquire at the end of flattening operation is computed. To correct the parallelism, a quantity of material removed is computed so that the resultant thickness may approach the region of the substrate surface whose thickness is computed to be the thinnest. Then a residence time of the processing tool is computed therefrom.

In this case, if the back surface is acceptably flat, the back surface is made the reference surface, and a residence time of the processing tool is computed such that the front surface becomes parallel to the back surface. From this residence time combined with the previously computed residence time required for flattening of the front surface, a final residence time of the processing tool required for processing of the surfaces may be determined. More preferably, a plane to which the surfaces are to be processed parallel is assumed within the substrate, and a residence time on each of the front and back surfaces is computed such that for each of the front and back surfaces, the thickness at any other positions on each of the front and back surfaces may approach the thickness at the position on each of the front and back surfaces corresponding to the thinnest portion on the substrate surface. Using the residence time combined with the previously computed residence time required for flattening of the front and back surfaces, a final quantity of material removed, and hence, a final residence time of the processing tool required at each position for correcting the flatness and parallelism on both the surfaces is determined. Then the substrate is processed on each surface while increasing or decreasing the velocity rate of the processing tool on each surface for controlling the residence time according to the final residence time schedule.

It is understood that the above procedure is to accomplish desired processing by controlling the velocity rate of the processing tool. The processing may additionally or instead be accomplished by controlling the air blasting pressure of the processing tool as will be described later.

The processing tool used herein is adapted to blast a slurry of suspended microparticulates in water carried on compressed air against the substrate. If microparticulates are not suspended in water, as in the case of dry sand blasting, for example, there is a likelihood of brittle fracture. The reason is that as the particle size of microparticulates decreases, such microparticulates are more likely to agglomerate together into larger particles, and when such larger particles collide against the substrate surface, brittle fracture can occur.

The microparticulates suspended in water to form the slurry for the processing tool are preferably selected from ceria (cerium oxide), silica (silicon oxide), and alumina (aluminum oxide), though not critical. Such microparticulates preferably have an average particle size of up to 3 μm, more preferably 0.5 μm to 2 μm. With an average particle size of more than 3 μm, microcracks can develop on the substrate surface as a result of processing. An average particle size of less than 0.5 μm may lead to a slower removal rate, at which a longer time is taken for processing. The average particle size as used herein is determined by a laser light diffraction type particle size distribution meter, Coulter counter or the like.

The amount of microparticulates in the slurry is preferably 2 to 30% by weight, more preferably 5 to 15% by weight. Too low a microparticulate concentration may take a longer time for processing. Too high a microparticulate concentration can lead to an insufficient dispersion of microparticulates in water, allowing microparticulates to form agglomerates which tend to form microcracks on the substrate surface. The slurry may be prepared by conventional techniques. Additives may be added to the slurry, for example, dispersants for helping disperse microparticulates and surfactants for preventing drying or improving a cleaning ability.

Utilizing a pneumatic pressure, the slurry is blasted against the substrate. The pneumatic pressure is correlated to the identity of microparticulates and the distance between processing tool and substrate, and cannot be unequivocally determined. Preferably the pneumatic pressure is adjusted by observing the removal rate and whether or not brittle fracture is induced. The pneumatic pressure is typically from 0.05 MPa to 0.5 MPa, and more preferably from 0.05 MPa to 0.3 MPa. A pneumatic pressure of less than 0.05 MPa may take a longer time for processing whereas a pneumatic pressure of more than 0.5 MPa may cause microcracks to the substrate surface.

The structure adapted to blast the slurry against the substrate utilizing a pneumatic pressure is not particularly limited. One typical structure is a double-tube nozzle wherein the slurry is fed through the center tube and air is fed through the surrounding space. The velocity rates of the slurry and air vary with the nozzle size although they are preferably adjusted to give an A/B ratio from 20 to 500, more preferably from 50 to 300, provided the velocity rate of slurry is A ml/min and the velocity rate of air is B $Nm^3$/min. An A/B ratio of less than 20 may take a longer time for processing whereas an A/B ratio of more than 500 may cause microcracks to the substrate surface.

Figure 3:
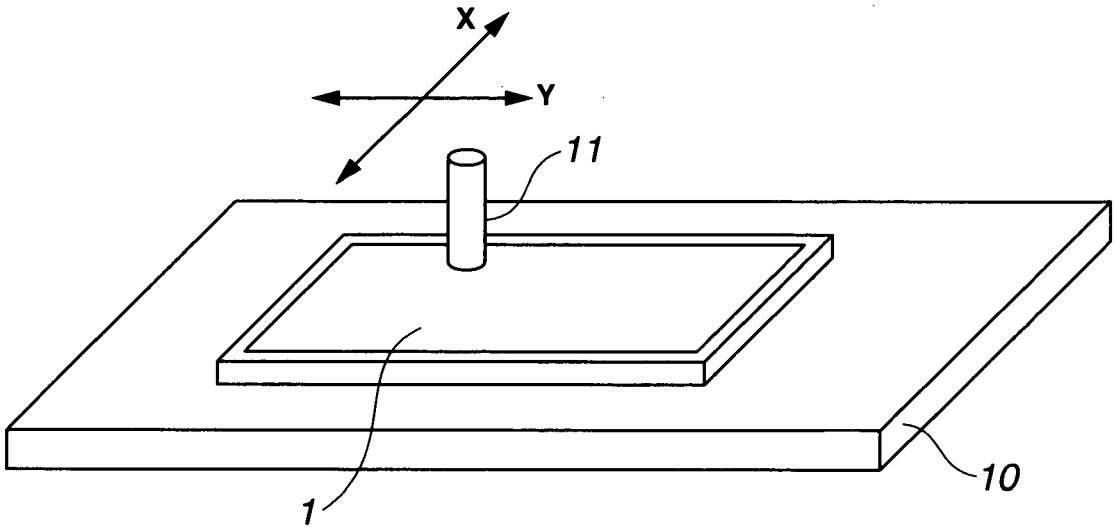
FIG. 3 is a perspective view of a processing apparatus.

With respect to the processing technique for tailoring parallelism and flatness, processing may be carried out using an apparatus as shown in FIG. 3, for example. In FIG. 3, a substrate 1 is held on a platform 10, and a processing tool 11 is movable over the substrate 1 in X and Y directions. The movement of the processing tool 11 can be computer controlled. Equivalent processing is possible with an X-θ mechanism.

In an embodiment wherein such a processing tool is used to process a surface of interest (one surface or each surface) of a large-size substrate to a desired flatness and optionally a desired parallelism, raised portions and thick portions on the substrate surface of interest are partially removed by means of the processing tool in accordance with the residence time of the processing tool at each point computed from the measured data.

The term "raised portions" as used herein refers to those portions on a surface to be flattened which are higher than the lowest point when its least square plane is made the reference surface. The term "thick portions" as used herein refers to those portions which are thicker than the portion whose thickness is determined to be thinnest, when the processing is intended for parallelism tailoring.

In the above embodiment, while the air blasting pressure of the processing tool is set constant, for the point for which a larger quantity of material removed is assigned, the velocity rate of the processing tool is slowed down to increase the residence time. On the other hand, for the point for which a smaller quantity of material removed is assigned, the velocity rate of the processing tool is accelerated to reduce the residence time. The processing is performed by controlling the residence time in this way.

Instead, while the velocity rate of the processing tool is set constant, the processing is achievable through pressure control, such as by increasing the air blasting pressure of the processing tool at the point for which a larger quantity of material removed is assigned and reducing the air blasting pressure at the point for which a smaller quantity of material removed is assigned.

In the invention, the removal rate by processing varies with the particle size of suspended microparticulates, the material of the substrate, the pneumatic pressure, the distance between processing tool and substrate surface, and the like. It is then necessary that the processing characteristics be previously acknowledged using the processing tool and processing conditions employed, and be reflected on the residence time and air blasting pressure of the processing tool.

It is preferred that processing be performed on both the front and back surfaces whereby the flatness of both the front and back surfaces is enhanced. It is more preferred that processing be performed to enhance parallelism as well.

Provided that a large-size substrate before the processing has a flatness of 10 to 50 μm, especially 10 to 30 μm on the front and back surfaces and a parallelism of 2 to 30 μm, especially 2 to 15 μm, merely processing the front and back surfaces according to the invention results in the substrate having a flatness of 2 to 20 μm, especially 2 to 10 μm on the front and back surfaces and a parallelism of 1 to 20 μm, especially 1 to 10 μm. That is, the flatness on each of the front and back surfaces after processing is ½ to 1/20, especially ⅕ to 1/20 of that before processing, and the parallelism after processing is ½ to 1/10, especially ⅕ to 1/10 of that before processing. Although these improvements are achieved by processing both the front and back surfaces, the front surface may be solely processed when only that surface requires a certain flatness.

Once processed as above, post-processing is not always necessary. In the context of surface polishing, polishing by the inventive process may be a final polishing.

In the preparation method of the invention, raised portions and thick portions of the substrate are selectively removed by the above method without inducing brittle fracture. This eliminates a need for subsequent polishing, that is, a need for the management of machine accuracy in subsequent steps. A high flatness substrate can be produced within a short time.

EXAMPLE

Examples of the invention are given below by way of illustration and not by way of limitation. In Examples, parallelism and flatness were measured using a flatness tester FTT-1500 by Kuroda Precision Industries Ltd.

Example 1

A starting substrate was furnished by lapping a synthetic quartz substrate dimensioned 520 mm×800 mm (diagonal length 954 mm)×10.5 mm (thick) by means of a planetary motion double-side lapping machine using abrasives GC#600 (Fujimi Abrasive Co., Ltd.) and then polishing on both the surfaces using ceria abrasives having an average particle size of 1 μm. The starting substrate was as accurate as having a flatness of 20 μm on the front surface, a flatness of 22 μm on the back surface and a parallelism of 4 μm and was of a shape having a higher center portion.

The starting substrate was mounted on the platform 10 of the apparatus shown in FIG. 3. The processing tool 11 was movable in X and Y directions and substantially parallel to the platform 10. The slurry-blasting orifice of the processing tool 11 was spaced from the surface of the substrate 1 by a distance of 100 mm. The processing tool 11 was of a double tube configuration that feeds a slurry through the center tube and air through the surrounding annular space so as to blast the slurry-carrying air against the substrate. The slurry used was prepared by suspending ceria microparticulates having an average particle size of 1 μm in water to form a 10 wt % slurry.

Figure 4:
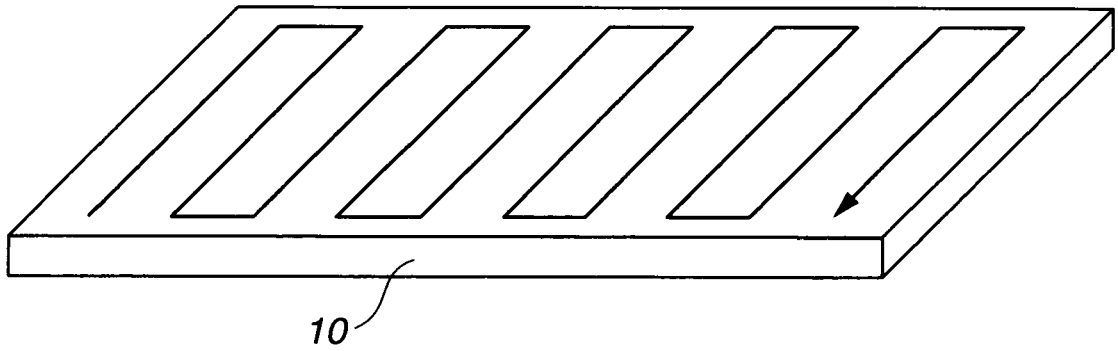
FIG. 4 is a perspective view showing the traverse mode of a processing tool.

The processing technique involved moving the processing tool continuously parallel to X axis, then moving a distance or pitch of 10 mm in Y axis direction, and so on as shown in FIG. 4. During the process, the velocity rate of the slurry was 400 ml/min, the pressure of air was 0.3 MPa, and the velocity rate of air was 2 $Nm^3$/min. From the previously measured values, the processing rate under these conditions was computed to be 1 μm/min and set lower at positions nearer to the periphery. The velocity rate of the processing tool was 50 mm/sec at the portion to which a smallest quantity of material removed was assigned on calculation. The velocity rate of the processing tool at a certain position along the substrate is computed from a necessary residence time of the processing tool at that position which is determined from the processing rate and the processing profile. The processing position is shifted by moving the processing tool accordingly. In this way, both the major surfaces of the substrate were processed.

The processed substrate was as accurate as having a flatness of 3.6 μm on the front surface, a flatness of 3.7 μm on the back surface and a parallelism of 2.1 μm, and underwent no brittle fracture.

Example 2

The procedure of Example 1 was repeated except that microparticulate ceria having an average particle size of 3 μm was used.

Example 3

The procedure of Example 1 was repeated except that microparticulate alumina having an average particle size of 2 μm was used.

Example 4

The procedure of Example 1 was repeated except that microparticulate silica having an average particle size of 2 μm was used.

Example 5

The procedure of Example 1 was repeated except that the air pressure was 0.5 MPa.

Example 6

The starting substrate had a flatness of 22 μm on the front surface, a flatness of 24 μm on the back surface and a parallelism of 15 μm. It was processed as in Example 1.

The results of Examples 1 to 6 are summarized in Table 1.

TABLE 1

| | Flatness before processing, front/back (μm) | Parallelism before processing (μm) | Air pressure (MPa) | Micro-particulates and size | Flatness after processing, front/back (μm) | Parallelism after processing (μm) | Brittle fracture |
|---|---|---|---|---|---|---|---|
| Example 1 | 20/22 | 4 | 0.3 | ceria 1 μm | 3.6/3.7 | 2.1 | none |
| Example 2 | 18/18 | 5 | 0.3 | ceria 3 μm | 2.5/3.0 | 2.2 | none |
| Example 3 | 22/17 | 8 | 0.3 | alumina 2 μm | 2.8/3.3 | 1.9 | none |
| Example 4 | 20/20 | 6 | 0.3 | silica 2 μm | 3.0/2.9 | 2.4 | none |
| Example 5 | 22/19 | 5 | 0.5 | ceria 1 μm | 2.3/3.5 | 2.3 | none |
| Example 6 | 22/24 | 15 | 0.3 | ceria 1 μm | 3.5/3.9 | 2.3 | none |

Comparative Example 1

The procedure of Example 1 was repeated except that microparticulate alumina having an average particle size of 10 μm was blasted in a dry state without suspending in water.

Comparative Example 2

The procedure of Example 1 was repeated except that microparticulate ceria having an average particle size of 1 μm was blasted in a dry state without suspending in water.

The results of Comparative Examples 1 and 2 are summarized in Table 2.

TABLE 2

| | Flatness before processing, front/back (μm) | Parallelism before processing (μm) | Air pressure (MPa) | Micro-particulates and size | Flatness after processing, front/back (μm) | Parallelism after processing (μm) | Brittle fracture |
|---|---|---|---|---|---|---|---|
| Comparative Example 1 | 22/18 | 8 | 0.3 | alumina 10 μm | 3.2/3.2 | 2.5 | every-where |
| Comparative Example 2 | 20/16 | 6 | 0.3 | ceria 1 μm | 3.2/3.8 | 2.9 | local |

Japanese Patent Application No. 2004-041396 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a large-size substrate, comprising the steps of:

measuring the flatness of one surface or opposite surfaces of a large-size substrate having a diagonal length of at least 500 mm, and partially removing raised portions on the one surface or opposite surfaces of the substrate by means of a processing tool on the basis of the measured data, for thereby improving the flatness of the substrate, said processing tool being adapted to blast a slurry of microparticulates in water carried on compressed air against the substrate.

2. The method of claim 1, wherein the measuring step includes measuring the flatness of opposite surfaces of a large-size substrate and measuring the parallelism thereof, and the partially removing step includes partially removing raised portions and thick portions on the opposite surfaces of the substrate by means of a processing tool on the basis of the measured data.

3. The method of claim 1, wherein the microparticulates are of ceria, silica or alumina.

4. The method of claim 1, wherein the microparticulates have an average particle size of up to 3 μm.

5. The method of claim 1, wherein the compressed air has a pressure of 0.05 to 0.5 MPa.

6. The method of claim 1, wherein the large-size substrate is a synthetic quartz glass substrate.

7. The method of claim 1, wherein the large-size substrate is an array side substrate for TFT liquid crystal.

* * * * *